US005302483A

United States Patent [19]

Yamane et al.

[11] Patent Number: 5,302,483

[45] Date of Patent: Apr. 12, 1994

[54] IMAGE FORMING METHOD COMPRISING THE USE OF A DEVELOPER HAVING COMPLEX PARTICLES THEREIN

[75] Inventors: Kenji Yamane; Kazuhisa Horiuchi; Hiroshi Yamazaki, all of Hino, Japan

[73] Assignee: Konica Corporation, Tokyo, Japan

[21] Appl. No.: 840,445

[22] Filed: Feb. 24, 1992

[30] Foreign Application Priority Data

Feb. 28, 1991 [JP] Japan ..... 3-55527

[51] Int. Cl.[5] ..... G03G 13/16

[52] U.S. Cl. ..... 430/126; 430/108

[58] Field of Search ..... 430/106, 109, 110, 126, 430/108

[56] References Cited

U.S. PATENT DOCUMENTS 5,077,169 12/1991 Inoue et al. ..... 430/109
5,077,170 12/1991 Tsujihiro ..... 430/109
5,139,914 8/1992 Tomiyama et al. ..... 430/109

*Primary Examiner*—John Goodrow
*Attorney, Agent, or Firm*—Jordan B. Bierman

[57] ABSTRACT

An electrophotographic image forming method is disclosed. The method includes a step of forming a static image on an amorphous silicon photoreceptor and a step of developing the image by a developer. The developer comprises a toner comprising colored particles comprising a resin and a colorant; and complex particles comprising resin particles comprising an acryl polymer, a styrene polymer or a styrene-acryl copolymer and hydrophobicized microparticles of an inorganic oxide which are bound to the surface of the resin particles.

14 Claims, 1 Drawing Sheet

IMAGE FORMING METHOD COMPRISING THE USE OF A DEVELOPER HAVING COMPLEX PARTICLES THEREIN

FIELD OF THE INVENTION

The present invention relates to an image forming method for electrophotography, electrostatic recording, electrostatic printing and other processes.

BACKGROUND OF THE INVENTION

As a traditional method of obtaining an electrostatic developer, complex particles are added to a developer cf. Japanese Patent Publication Open to Public Inspection (hereinafter referred to as Japanese Patent O.P.I. Publication) No. 91143/1989. In this method, complex particles, comprising resin particles whose average grain size is smaller than that of colored particles at 0.05 to 3.0 μm and inorganic microparticles bound to the surface of the resin grains, are used to keep the surface of the photoreceptor in a good condition by the polishing action thereof and hence improve the cleaning property.

However, when used for the image formation process using an amorphous silicon photoreceptor, the developer disclosed in Japanese Patent O.P.I. Publication No. 91143/1989 poses the following problems:

(1) When cleaning is performed while a cleaning device is placed on the surface of the amorphous silicon photoreceptor under relatively high pressure to improve the cleaning property in the cleaning process, the complex particles between the cleaning device and the surface of the amorphous silicon photoreceptor undergo a great pressurizing force; therefore, resin particles constituting the nuclei of the complex particles are destroyed, and the morphology and surface properties of the complex particles become poor, which results in cleaning failure.

(2) When complex resin particles are destroyed as above, resin dust occurs, which is bound to the surface of the amorphous silicon photoreceptor by the cleaning device and thus forms a film on the surface of the amorphous silicon photoreceptor. As a result, potential reduction occurs there, resulting in black dot stain and black streak stain. In addition, the surface properties of the photoreceptor deteriorate early; repeated image formation is accompanied by image density reduction.

(3) Upon complex resin particle destruction, inorganic microparticles are detached and inorganic micro dust are formed. The micro dust damages the surface of the amorphous silicon photoreceptor and fails to be cleaned off because it is embedded in the damaged portion on the surface of the amorphous silicon photoreceptor. As a result, the toner adheres to the embedded inorganic microparticles and is fixed in the image formation process which follows, leading to the problem of black dot stain and black streak strain on the image.

(4) Under high-temperature high-humidity conditions, charge leaks into the atmosphere due to too high temperature or leaks into water adsorbed to the surface of the photoreceptor, which tends to cause image failure, the phenomenon in which latent imaging failure makes the image portion corresponding to the deteriorated portion unclear or makes lateral lines lost easily. In conventional complex particles, because the inorganic microparticles are covered by hydroxyl groups, the surface adsorbs water under high-temperature high-humidity conditions; if cleaning is performed in such a state, the surface of the photoreceptor adsorbs water and leads to imaging failure upon sweeping off the residual toner.

(5) Water adsorption under high-temperature high-humidity conditions affects the triboelectric charging property of toner particles to provide a region of charge leakage. Repeated image formation leads to image density reduction and fogging.

SUMMARY OF THE INVENTION

The object of the present invention is to provide a method of image formation, wherein the cleaning property is good, no imaging failure occurs, the image density is stable and neither fogging nor toner scattering occurs under high-temperature high-humidity conditions.

The image forming method according to the present invention comprises steps of forming an static image on an amorphous silicon electrophotographic photo receptor; devoloping the static image with a developer to form a toner image; transforming the toner image to an image receiving material and cleaning toner remaining on the surface of the amorphous silicon photoreceptor. The developer used in the method comprises a toner comprising colored particles comprising a resin and a colorant; and complex particles comprising particles of an acryl polymer, a styrene polymer or a styrene-acryl copolymer and hydrophobicized microparticles of an inorganic oxide bound to the surface of the resin particles.

Figure 1:
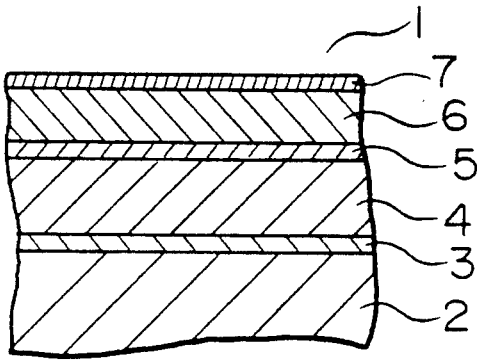
FIG. 1 is a cross-sectional view of an amorphous silicon photoreceptor for the method of image formation according to the present invention.

The present inventors found that destruction of complex particles by the pressurizing force between the amorphous silicon photoreceptor and the cleaning device in the prior art method is attributable to that 1) the resin constituting the resin particles forming the nuclei of the complex particles is susceptible to mechanical impact and that 2) the mechanical impact exerted on the complex particles is transmitted directly to the nucleus-forming resin particles because the inorganic microparticles are not sufficiently strongly bound to the resin particles. The inventors made further investigations based on this finding and developed the present invention.

Accordingly, the present invention offers remarkable improvement in the binding strength of inorganic oxide microparticles to resin particles because resin particles comprising an acrylic polymer, styrene polymer or styrene/acrylic copolymer are used to form the nuclei of complex particles and hydrophobicized inorganic oxide microparticles are used to constitute the surface of the complex particles. In fact, cross-sectional observation of the complex particles reveals that the inorganic oxide microparticles are embedded in the resin particles.

Although it remains unknown why such a remarkable improvement occurs in binding strength, it is attributable partially to the fact that 1) hydrophobicized inorganic oxide microparticles and resin particles of acrylic polymer, styrene polymer or styrene/acrylic copolymer are thoroughly uniformly mixed in the mixing process preceding binding because their triboelectric charging property is stable with no environmental dependence and that 2) they are easily bindable because of the good compatibility and are not liable to cause inorganic oxide microparticle detaching.

Therefore, when using a developer incorporating the complex particles described above, the improvement in binding strength suppresses resin particle destruction and inorganic oxide microparticle detaching, thus ensuring a satisfactory cleaning property even in the image formation process using an amorphous silicon photoreceptor.

Moreover, because the inorganic oxide microparticles constituting the surface of the complex particles have been hydrophobicized, a satisfactory cleaning property is obtained and no imaging failure occurs even under high-temperature high-humidity conditions. Additionally, the triboelectric charging property of toner is stable; the image density obtained is stable and no fogging occurs even in repeated image formation.

DETAILED DESCRIPTION OF THE INVENTION

The complex particles constituting the developer used for the present invention comprises resin particles of acrylic polymer, styrene polymer or styrene/acrylic copolymer and hydrophobicized inorganic oxide microparticles bound to the surface thereof.

The acrylic polymer constituting the resin particles is a homopolymer or copolymer obtained by polymerizing a monomer selected from the group comprising acrylic acid, acrylate, methacrylic acid and methacrylate. Examples of the acrylic monomer used to obtain such an acrylic polymer include acrylic acid, methyl acrylate, ethyl acrylate, n-butyl acrylate, isobutyl acrylate, propyl acrylate, n-octyl acrylate, dodecyl acrylate, lauryl acrylate, 2-ethylhexyl acrylate, stearyl acrylate, 2-chloroethyl acrylate, phenyl acrylate, methyl α-chloroacrylate, methacrylic acid, methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate, stearyl methacrylate, phenyl methacrylate, dimethylaminoethyl methacrylate and diethylaminoethyl methacrylate.

Although an acrylic polymer is obtained from one or more of the acrylic monomers mentioned above, one or more other monomers may be copolymerized as necessary in the present invention. In this case, it is preferable to use acrylic monomers at ratios of over 50% by weight in the monomer composition.

Examples of the styrene monomer used to obtain the styrene polymer constituting the resin particles include styrene, o-methylstyrene, m-methylstyrene, p-methylstyrene, α-methylstyrene, p-ethylstyrene, 2,4-dimethylstyrene, p-n-butylstyrene, p-tert-bytylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene and 3,4-dichlorostyrene.

Although a styrene polymer is obtained from one or more of the above-mentioned styrene monomers, one or more other monomers may be copolymerized as necessary in the present invention. In this case, it is preferable to use styrene monomers at ratios of over 50% by weight in the monomer composition.

Although the styrene/acrylic copolymer constituting the resin particles is obtained from a combination of one or more of the above-mentioned acrylic monomers and one or more of the above-mentioned styrene monomers, one or more other monomers may be copolymerized as necessary. In this case, it is preferable to use acrylic monomers and styrene monomers at total ratios of over 50% by weight in the monomer composition.

Examples of the other monomers described above include acrylic acid or methacrylic acid derivatives such as acrylonitrile, methacrylonitrile and acrylamide, vinyl esters such as vinyl acetate, vinyl butyrate and vinyl benzoate, vinyl ethers such as vinyl methyl ether and vinyl ethyl ether, vinyl ketones such as vinyl methyl ketone, dienes such as butadiene and isoprene and unsaturated carboxylic acids such as maleic acid and fumaric acid.

The average grain size of the resin particles constituting the complex particles is preferably 0.1 to 7.0 μm, more preferably 0.2 to 5.0 μm from the viewpoint of improvement in cleaning property and stability in triboelectric charging property. The average grain size of resin particles is defined as the average diameter determined on the basis of volume using the laser diffraction particle size distribution analyzer HELOS (produced by Sympatec Company) equipped with a wet mechanical disperser. Prior to determination, resin particles in an amount of several tens mg along with surfactant were dispersed in 50 ml of water, followed by pretreatment of 1 to 10 minutes of dispersion using an ultrasonic homogenizer with an output power of 150 W while paying attention to avoid re-aggregation due to heating.

The inorganic microparticle of the invention preferably comprises a sparingly water-soluble inorganic oxide compound having a micro Vickers hardness of from 300 to 2500 for obtaining a good cleaning and polishing properties. The micro Vickers hardness is determined as follows:

To a polished flat surface of the specimen to be tested, a quadrangular pyramic tip of diamond having a facing angle of 120° is pressed with a prescribed pressure F to make a pit on the surface. Length of diagonal line of the pit d is measured and the micro Vickers hardness $H_{Mv}$ of the specimen is calculated by the following equation:

$$H_{Mv} = 1.8554\ F/d^2$$

When the material to be determined is a powder, the powder is fixed with a two-component type hardening resin in a form of mass. The mass of the powder is polished by a emery paper to expose the surface of powder particle and lapped to make a flat surface of the powder particle to be tested. The detailed procedure for determining the micro Vickers hardness is described in Japanese Industrial Standard, JIS Z 2251.

The inorganic oxide microparticles constituting the complex particles have been hydrophobicized to a degree of hydrophobicity of preferably not less than 30. The degree of hydrophobicity is determined by the methanol wettability method as follows.

The degree of hydrophobicity is evaluated on the basis of wettability against methanol, which is expressed in methanol number as determined by methanol titration as follows. To a 250 ml beaker containing 50 ml of distilled water, 0.2 g of the subject inorganic oxide particles are taken. Methanol is added dropwise using a burette being immersed in liquid until all the hydrophobicized inorganic oxide particles become wet, while gently stirring using a magnet stirrer. When the amount of methanol required to wet all the inorganic oxide particles is "a" (ml), the degree of hydrophobicity is calculated by the following equation.

$$\text{Degree of hydrophobicity} = \frac{a}{50 + a} \times 100$$

Examples of hydrophobicizing agents for the inorganic oxide microparticles include titanium coupling agents, silane coupling agents, long chain carboxylic acids and metal salts thereof, and surfactants.

Examples of titanium coupling agents include tetrabutyl titanate, tetraoctyl titanate, isopropyltriisostearoyl titanate, isopropyltridecylbenzenesulfonyl titanate and bis(dioctylpyrophosphate)oxyacetate titanate.

Examples of silane coupling agents include γ-(2-aminoethyl)aminopropyltrimethoxysilane, γ-(2-aminoethyl)aminopropylmethyldimethoxysilane, aminosilane, γ-methacryloxypropyltrimethoxysilane, N-β-(N-vinylbenzylaminoethyl)-γ-aminopropyltrimethoxysilane hydrochloride, hexamethyldisilazane, methyltrimethoxysilane, methyltriethoxysilane, vinyltriacetoxysilane, γ-mercaptopropyltrimethoxysilane, γ-anilinopropyltrimethoxysilane, methyltrichlorosilane, dimethyldichlorosilane, trimethylchlorosilane and γ-glycidoxypropyltrimethoxysilane.

Examples of long chain carboxylic acids and metal salts thereof include long chain carboxylic acids with 10 or more carbon atoms such as undecyl acid, lauric acid, tridecyl acid, myristic acid, pentadecylic acid, stearic acid, palmitic acid, heptadecylic acid, arachic acid, montanic acid, oleic acid, linolic acid, linolenic acid and arachidonic acid and metal salts thereof.

Examples of surfactants include ordinary surfactants such as sorbitan surfactants, sulfonic acid surfactants, phosphoric acid surfactant and fluorine surfactants.

The above-mentioned hydrophobicizing agents may be used singly or in combination.

In the surface treatment of the inorganic oxide microparticles, it is preferable to perform filtration and drying after mixing and dispersing the inorganic oxide microparticles and one of the above-mentioned hydrophobicizing agents in a medium such as a solvent and treating such as heating for a given time.

The primary average grain size of the inorganic oxide microparticles constituting the complex particles is preferably 0.01 to 1 μm, more preferably 0.01 to 0.5 μm from the viewpoint of improvements in cleaning property, polishing property and filming resistance. The primary average grain size of inorganic oxide microparticles is defined as the number-average grain size determined by scanning electron microscopic image analysis.

Examples of materials which constitute the inorganic oxide particles include oxides such as silicon oxide, aluminum oxide, titanium oxide, zinc oxide, zirconium oxide, chromium oxide, cerium oxide, tungsten oxide, antimony oxide, copper oxide, tin oxide, tellurium oxide, manganese oxide, boron oxide, barium titanate, magnesium titanate, calcium titanate and strontium titanate. Among these inorganic oxide compound, titanium oxide, aluminum oxide, silicon oxide, and zirconium oxide are particularly preferable.

The complex particles comprise hydrophobicized inorganic oxide microparticles bound to the surface of resin particles. In this context, binding means a state in which the inorganic oxide microparticles are embedded in the resin particles to the extent that the embedded length is 5 to 95% of the full length rather than simple electrostatic adhesion of the inorganic oxide particles to the resin particles. Such a state can be confirmed by observing the surface of the complex particles using a transmission electron microscope or ordinary electron microscope.

In binding inorganic oxide particles to the surface of resin particles, it is preferable to first sphere the resin particles and then bind the inorganic oxide microparticles to the surface thereof. This is because when the resin particles are sphere, the inorganic oxide microparticles are uniformly bound so that the detaching of the inorganic oxide microparticles is well prevented.

Examples of means of sphering resin particles include 1) the method in which the resin particles are first thermally molten and then subjected to spray granulation, 2) the method in which thermally molten resin particles are jet-discharged into water to sphere them, and 3) the method in which sphere resin particles are synthesized by suspension polymerization or emulsion polymerization.

Examples of means of binding inorganic oxide microparticles on the surface of resin particles include the method in which resin particles and inorganic oxide microparticles are mixed and then heated, and the mechanochemical method in which inorganic oxide microparticles are mechanically bound to the surface of resin particles.

Specifically, usable methods include 1) the method in which resin particles and inorganic oxide microparticles are stirred and mixed using a Henschel mixer, V-shaped mixer, turbular mixer or the like to electrostatically adhere the inorganic oxide microparticles to the surface of the resin particles, and then the resin particles bound carrying the inorganic oxide microparticles adhered thereon are introduced into a heat treatment apparatus such as a double-nozzle atomizer or spray drier and heated to thermally soften the surface of the resin particles and bind the inorganic oxide microparticles to the softened surface, and 2) the method in which inorganic oxide microparticles are electrostatically bound to the surface of resin particles, and then an apparatus capable of exerting mechanical force as a modification of impact pulverizer, such as Ang mill, free mill or hybridizer, is used to bind the inorganic oxide microparticles to the surface of the resin particles.

In preparing complex particles, the amount of inorganic oxide microparticles added relative to resin particles is such that the surface of the resin particles is uniformly covered. Specifically, although varying depending on the specific gravity of the inorganic oxide microparticles, the inorganic oxide microparticles are used at normally 5 to 100% by weight, preferably 5 to 80% by weight of the resin particles.

The complex particles thus obtained are mixed with colored particles to yield a toner. The ratio of complex particles added is preferably 0.01 to 5.0% by weight, more preferably 0.01 to 2.0% by weight of the amount of colored particles from the viewpoint of improvement in cleaning property and stability of triboelectric charging property.

The colored particles constituting the developer of the present invention comprises a resin and a colorant. The average grain size of the colored particles is preferably in the range from 1 to 30 μm.

Examples of the resin used to constitute the colored particles include polyester resin, styrene resin, acrylic resin, styrene/acrylic copolymer resin and epoxy resin.

Examples of the colorant used to constitute the colored particles include carbon black, Nigrosine dye, Aniline Blue, Chalco Oil Blue, Chromium Yellow, Ultramarine Blue, Du-Pont Oil Red, Quinoline Yellow, Methylene Blue Chloride, Phthalocyanine Blue, Malachite Green Oxalate, Lamp Black and Rose Bengale.

The colored particles may contain other additives as necessary. Examples of such other additives include charge control agents and fixability improvers.

Examples of charge control agents include salicylic acid derivatives. Examples of fixability improvers include low molecular polypropylene.

For obtaining a magnetic toner, magnetic particles are added as an additive to the colored particles. Examples of such magnetic particles include ferrite particles, magnetite particles and other particles with an average grain size of 0.1 to 2 μm. The amount of magnetic particles added is normally 20 to 70% by weight of the colored particles not including the external additives such as complex particles.

In the present invention, inorganic particles may be externally added to the mixture of colored particles and complex particles to yield a toner. The inorganic particles enhance the fluidity of toner. Examples of such inorganic particles used preferably for the invention include silica microparticles subjected to surface treatment with a hydrophobicizing agent such as a silane coupling agent or titanium coupling agent.

In a mode of embodiment of the method of producing the toner constituting the developer of the invention, a resin constituting the colored particles, a colorant and other additives used as necessary are mixed, melt kneaded and cooled, after which they are pulverized and classified to yield colored particles with the desired average grain size. Next, the colored particles and complex particles are mixed using a Henschel mixer or another apparatus to electrostatically adhere the complex particles to the surface of the colored particles to yield a toner.

The developer for the present invention may be either a two-component developer prepared by mixing a carrier in the toner or a one-component developer comprising the magnetic toner alone.

The carrier constituting the two-component developer is preferably a coated carrier comprising a resin-coated magnetic particles from the viewpoint of improvement in developer durability. Such magnetic particles are ferrite particles, magnetite particles and others. The coating resin is a styrene/acrylic copolymer or another resin.

The average grain size of the carrier is normally 30 to 150 μm.

The developer for the present invention is used for the image formation process comprising electrostatic image formation on an amorphous silicon photoreceptor, development of the electrostatic image with a developer to yield a toner image, the toner image is transferred to an image receiving material, and then the residual toner on the surface of the amorphous silicon photoreceptor is cleaned off.

Each process is described in detail below.

Electrostatic image formation process

The surface of an amorphous silicon photoreceptor is uniformly charged using a corona discharger or another means and then subjected to imagewise exposure using an exposuring optical system to yield an electrostatic image on the amorphous silicon photoreceptor. Hereinafter, amorphous silicon is optionally referred as a-Si.

It is preferable to use a lamination type amorphous silicon photoreceptor with a surface improving layer, since it does not cause environmental pollution, it is excellent in light resistance, corona ion resistance, temperature/humidity resistance and wear resistance and it offers improvements in transferability and cleaning property in the image formation process. The surface improving layer preferably comprises a layer prepared by introducing a kind of halogen atom (X) such as hydrogen atom and/or fluorine atom into an amorphous silicon layer to block the dangling bond, hereinafter referred to as the a-Si:H(X) layer and further introducing an property improving atom (Y) such as carbon atom, oxygen atom or nitrogen atom.

The surface improving layer possesses excellent photoconductivity and its dark resistance has been increased to $10^{12}$ to $10^{13}$ Ω·cm as a result of incorporation of the improving atom (Y). Contray to this, the dark resistance of an ordinary a-Si:H layer is within the range of from $10^{8}$ to $10^{9}$ Ω·cm. As a result, the charge retention capability of the amorphous silicon photoreceptor is much higher. Also, its resistance to repeated charging and exposure is stable.

The surface improving layer may be formed directly on the photoconductive layer or may be formed on an interlayer provided on the photoconductive layer. The photoconductive layer may be of the separate function type in which charge generation and charge transportation are assigned to different layers. When such a multiple layered photoconductive layer is used, the surface improving layer is formed on the outermost layer of the photoconductive layer.

FIG. 1 shows an example configuration of amorphous silicon photoreceptor for the present invention. In FIG. 1, the numerical symbol 1 represents an amorphous silicon photoreceptor. When the charging polarity is positive, a P+ type charge blocking layer 3, a charge transport layer 4, an interlayer 5, a charge generation layer 6 and a surface improving layer 7 are sequentially formed in this order on a drum of base 2 comprising aluminum or another material to yield the amorphous silicon photoreceptor 1.

The P+ type charge blocking layer 3 is preferably configured with a layer containing at least one kind of surface property improving atom (Y) such as a carbon atom, oxygen atom or nitrogen atom, e.g., a-Si:C:H(X) layer, a-Si:C:0:H(X) layer, a-Si:N:H:(X) layer, a-Si:N:0:H(X) layer, a-Si:0:H:(X) layer and a-Si:C:0:N:H(X) layer, wherein a Group 3A element such as boron, aluminum or gallium has been heavily doped. The content of the surface property improving atom (Y) is preferably 0.5 to 40 atm %. The thickness of the charge blocking layer 3 is preferably 0.01 to 10 μm.

The charge transport layer 4 is preferably configured with an a-Si:Y:H(X) layer containing at least one kind of surface property improving atom (Y) such as carbon atom, oxygen atom or nitrogen atom as with the charge blocking layer 3, wherein a Group 3A element has been light doped. The content of the surface property improving atom (Y) is preferably 0.5 to 40 atm %. To improve the chargeability and sensitivity, boron atoms may be introduced for making intrinsic condition. The thickness of the charge transport layer 4 is preferably 5 to 50 μm and preferably greater than that of the charge generation layer 6.

The interlayer 5 is provided as necessary to increase carrier injection efficiency. It is preferably configured with an a-Si:Y:H(X) layer containing at least one kind of surface property improving atom (Y) such as carbon atom, oxygen atom or nitrogen atom. The content of the surface property improving atom (Y) is preferably lower than that in the charge transport layer 4, particularly about one-sixth of that of the charge transport layer 4. Specifically, it is preferably 0.01 to 40 atm %. It is also preferable to light dope a Group 3A element in the interlayer 5. The thickness of the interlayer 5 is preferably 0.01 to 2 μm. The interlayer 5 may comprise two or more laminated layers.

The charge generation layer 6 is preferably configured with an a-Si:H(X) layer wherein a Group 3A element has been lightly doped as necessary. To improve the chargeability, boron atoms may be introduced for making intrinsic condition to increase the resistivity and raise the carrier mobility. The thickness of the charge generation layer 6 is preferably 2 to 15 μm.

The surface improving layer 7 is preferably configured with an a-Si:Y:H(X) layer prepared by introducing at least one kind of surface property improving atom (Y) such as carbon atom, oxygen atom or nitrogen atom into an a-Si:H(X) layer prepared by introducing a kind of halogen atom(X) such as hydrogen atom and/or fluorine atom into the amorphous silicon layer to block the dangling bond. Specifically, various configurations can be used, including a-Si:C:H(X) layer, a-Si:C:0:H(X) layer, a-Si:N:H(X) layer, a-Si:N:0:H(X) layer, a-Si:C:N:H(X) layer and a-Si:C:N:0:H(X) layer.

With respect to the surface improving layer 7, the content of the surface property improving atom (Y) such as carbon atom, oxygen atom or nitrogen atom is preferably 0.5 to 90 atm % relative to the total content of silicon atom and surface property improving atom (Y). When the surface property improving atom (Y) is the oxygen atom, its content is preferably 0.5 to 70 atm %. When two or more different kinds of surface property improving atom (Y) such as carbon atom, oxygen atom and nitrogen atom are contained, the ratio of carbon, oxygen and nitrogen atoms is preferably 0–90:0-.5–70:0–90 in atm %, and the total content of surface property improving atoms (Y) is preferably in the range from 0.5 to 90 atm %. The thickness of the surface improving layer 7 is preferably 0.04 μm to 1 μm.

A second interlayer may be provided between the charge generation layer 6 and the surface improving layer 7 as necessary. The surface property improving atom (Y) content in the second interlayer is preferably smaller than that in the surface improving layer 7.

The above-mentioned layers constituting the amorphous silicon photoreceptor 1 preferably have a kind of halogen atom (X) such as hydrogen atom and/or fluorine atom. It is especially important to add hydrogen atoms to the charge generation layer 6 for improving the photoconductivity and charge retention by blocking the dangling bond. Specifically, the hydrogen atom content is preferably 10 to 30 atm %. With respect to the hydrogen atom content, the same applies to the surface improving layer 7, interlayer 5, charge blocking layer 3 and charge transport layer 4. As an impurity substance for controlling the photoconduction type, Group 3A elements such as aluminum, gallium, indium and thallium, as well as boron, can be used for conversion to the P type.

To block the dangling bond during formation of each of the layers constituting the amorphous silicon photoreceptor, a kind of halogen atom, such as fluorine atom, in place of, or along with, the hydrogen atom, may be introduced in the form of $SiF_4$, for instance, to give an a-Si:F layer, a-Si:H:F layer, a-Si:C:F layer, a-Si:C:H:F layer, a-Si:C:O:F layer or a-Si:C:O:H:F layer. In this case, the fluorine atom content is preferably 0.5 to 10 atm %.

Each of the layers constituting the amorphous silicon photoreceptor 1 can be formed by, for example, glow discharge deposition, sputtering, ion plating and the method in which silicon is evaporated after introducing hydrogen activated or ionized using a hydrogen discharge tube described in Japanese Patent O.P.I. Publication No. 78413/1981.

The description given above is to describe the case where the charging polarity of the amorphous silicon photoreceptor 1 is positive. When the charging polarity of the amorphous silicon photoreceptor 1 is negative, the doping agent introduced into each of the charge blocking layer 3, charge transport layer 4, interlayer 5, charge generation layer 6 and surface improving layer 7 is replaced with a Group 5A element such as phosphorus, arsenic, antimony or bismuth. The charge blocking layer 3 and the interlayer 5 are provided as necessary and may be omitted.

The charge transport layer 4 and the charge generation layer 6 may be combined to a single layer.

The material for the base 2 may be conductive or insulating. Examples of conductive materials include metals such as stainless steel, aluminum, chromium, molybdenum, iridium, tellurium, titanium, platinum and palladium and alloys thereof. Examples of insulating materials include films or sheets of synthetic resins such as polyester, polyethylene, polycarbonate, cellulose acetate, polypropylene, polyvinyl chloride, polyvinylidene chloride, polystyrene and polyamide, glass, ceramics and paper. When using an insulating material, it is preferable to previously subject the it to an conduction treatment. When using glass, for instance, it can be made conductive by conduction treatment with indium oxide or tin oxide. In the case of synthetic resin films such as polyester films, they can be made conductive by conduction treatment with a metal such as aluminum, silver, lead, nickel, gold, chromium, molybdenum, iridium, niobium, tantalum, vanadium, titanium or platinum by vacuum deposition, electron beam deposition or sputtering, or by lamination with one of these metals.

The shape of the base 2 may be widely varied among cylinders, belts, plates and other shapes. When images are formed continuously at high speed, an endless belt or cylinder is preferred. The thickness of the base 2 is not subject to limitation and selected as appropriate according to productivity, handling, mechanical strength and other factors.

Developing process

The developer for the present invention is transported to the developing region using a developer transport carrier, where the electrostatic image formed on the surface of the amorphous silicon photoreceptor is developed.

The developer transport carrier preferably has a structure permitting application of bias voltage. For example, it is configured with a cylindrical sleeve having a developer layer on its surface and a magnet having a plurality of magnetic poles arranged in the sleeve. The developer layer on the sleeve is transported to the developing region by rotation of the sleeve and/or magnet.

For uniformizing the thickness of the developer layer being transported to the developing region, it is preferable to provide a thickness control means upstream the developing region in the developer transport carrier.

The bias voltage applied to the developing sleeve may be a direct current voltage or a super imposed voltage of direct current voltage and alternating current voltage.

Transfer process

The toner image formed on the amorphous silicon photoreceptor by development is transferred to an image receiving material such as paper.

The transfer process is preferably carried out by electrostatic transfer. Specifically, a transferring device generating direct current corona discharge, for instance, is arranged so that it faces the amorphous silicon photoreceptor via the image receiving material, and direct current corona discharge is applied to the image receiving material from the back face thereof to transfer the toner retained on the surface of the amorphous silicon photoreceptor to the surface of the image receiving material.

Cleaning process

The residual toner remaining untransferred on the surface of amorphous silicon photoreceptor is cleaned off using a cleaning apparatus equipped with a cleaning device such as a cleaning blade placed under pressure on the amorphous silicon photoreceptor.

The pressurizing force exerted on the amorphous silicon photoreceptor from the cleaning device is preferably 5 to 50 g/cm for improvement of the cleaning property.

Prior to the cleaning process, it is preferable to add a discharge process for eliminating the charge on the surface of the amorphous silicon photoreceptor to facilitate cleaning. This discharge process is carried out using, for instance, a discharger generating alternating current corona discharge.

Fixing process

The toner image transferred on the image receiving material is fixed after toner image transfer in the transfer process using a fixing apparatus such as heat roller fixer to form a fixed image.

Figure 2:
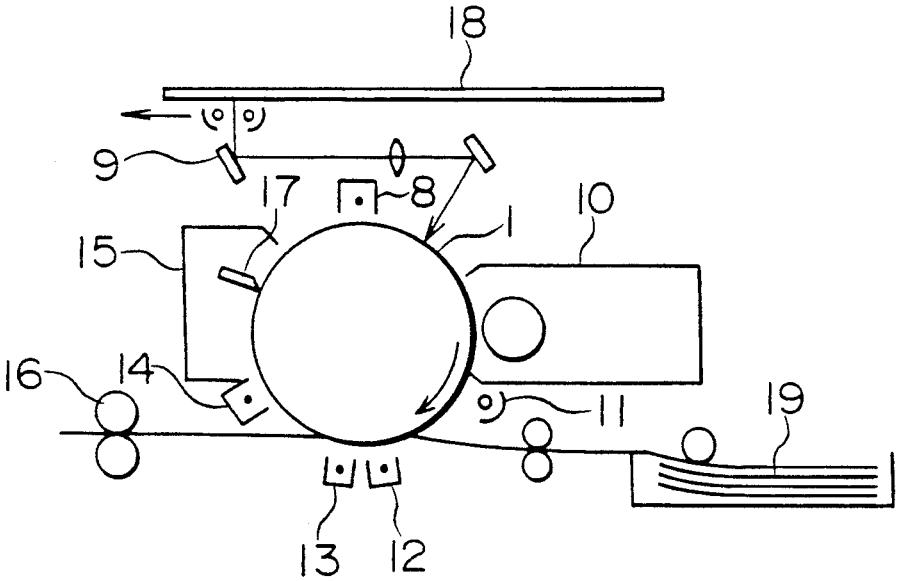
FIG. 2 is a schematic diagram of an image formation apparatus used for the method of image formation according to the present invention.

FIG. 2 illustrates a mode of the image formation apparatus capable of performing the image formation process described above. In FIG. 2, the numerical symbols represent an amorphous silicon photoreceptor 1, a charger 8, an exposuring optical system 9, a developing device 10, a discharging lamp 11, a transfer electrode 12, a separation electrode 13, a discharge electrode 14, a cleaning apparatus 15, a heat roller fixer 16, a cleaning blade 17, and an original table 18. This apparatus is of the type in which the exposuring optical system 9 is immobilized while the original table 18 is movable.

The charger 8 uniformly charges the surface of the amorphous silicon photoreceptor 1, which is then subjected to imagewise exposure by the exposuring optical system 9 to yield an electrostatic image corresponding to the original on the amorphous silicon photoreceptor 1. This electrostatic image is then developed by the developing device 10 to yield a toner image.

This toner image is discharged and made more transferable by the discharging lamp 11, after which it is transferred to image receiving paper 19 by the transfer electrode 12. The image receiving paper 19 is separated from the amorphous silicon photoreceptor 1 by the separation electrode 13 and then subjected to fixation treatment by the heat roller fixer 16 to yield a fixed image. On the other hand, the amorphous silicon photoreceptor 1 is discharged by the discharging electrode 14, and the residual toner remaining untransferred on the amorphous silicon photoreceptor 1 is scraped off by the cleaning apparatus 15.

The cleaning blade 17 is configured with an elastic material such as hard urethane rubber with a thickness of 1 to 3 mm, for instance, and has a length substantially equal to the width of the amorphous silicon photoreceptor 1, in the vertical direction with respect to the paper face in FIG. 2, and is retained by the blade holder (not illustrated) so that it can be shifted to the pressure contact on/off positions.

EXAMPLES

The present invention is hereinafter described in more detail by means of the following examples. In the examples given below, "part(s)" means "part(s) by weight".

Preparation Example of Complex Particles

The resin particles shown in Table 1 and the inorganic microparticles shown in Table 2 were thoroughly mixed with the combinations and ratios shown in Table 3 using a medium-containing V-shaped blender to electrostatically adhere the inorganic microparticles to the surface of the resin particles. Then, this mixture was charged in the "Hybridizer" (produced by Nara Kikai Seisakusho) and subjected to impact to yield complex particles wherein the inorganic microparticles have been bound to the surface of the resin particles.

Electron microscopic surface observation and transmission electron microscopy revealed that each complex particle thus obtained retains inorganic microparticles as embedded in the surface of a resin particle rather than as electrostatically adhered to the surface of the resin particle.

TABLE 1

| Resin particles | Composition | Average grain size |
|---|---|---|
| A (inventive) | Polymethyl methacrylate | 1.5 μm |
| B (inventive) | Methyl methacrylate/styrene copolymer (15/85) | 2.1 μm |
| C (inventive) | Methyl methacrylate/styrene copolymer (70/30) | 4.0 μm |
| D (inventive) | Polystyrene | 0.8 μm |
| a (comparative) | Silicone | 2.0 μm |

TABLE 2

| Inorganic oxide microparticles | Composition | Micro Vickers hardness | Hydrophobicizing agent | Degree of hydrophobicity | Average grain size (μm) |
|---|---|---|---|---|---|
| A (inventive) | Titanium oxide | 470 | Aluminum stearate | 40 | 0.015 |
| B (inventive) | Aluminum oxide | 1800 | Hexamethyldisilazane | 55 | 0.020 |
| C (inventive) | Zirconium oxide | 1650 | Tetraoctyltitanate | 60 | 0.030 |
| D (inventive) | Silicon oxide | 1070 | Aminosilane | 50 | 0.030 |

TABLE 2-continued

| Inorganic oxide microparticles | Composition | Micro Vickers hardness | Hydrophobicizing agent | Degree of hydrophobicity | Average grain size (μm) |
|---|---|---|---|---|---|
| a (comparative) | Titanium oxide | 470 | — | 15 | 0.015 |

TABLE 3

| Complex particles | Resin particles No. | Resin particles Amount added | Inorganic oxide microparticles No. | Inorganic oxide microparticles Amount added |
|---|---|---|---|---|
| A (inventive) | A | 100 parts | A | 25 Parts |
| B (inventive) | B | 100 parts | B | 18 Parts |
| C (inventive) | C | 100 parts | A | 40 Parts |
| D (inventive) | D | 100 parts | B | 50 Parts |
| E (inventive) | C | 100 parts | C | 40 Parts |
| F (inventive) | D | 100 parts | D | 70 Parts |
| a (comparative) | a | 100 parts | a | 20 Parts |
| b (comparative) | A | 100 parts | a | 25 Parts |
| c (comparative) | a | 100 parts | A | 20 Parts |

EXAMPLE 1

100 parts of binder resin (polyester resin), 10 parts of carbon black and 4 parts of polypropylene were mixed, kneaded, pulverized and classified to yield nonmagnetic colored particles 1 with an average grain size of 11.0 μm.

To the colored particles 1 were added fine powder of hydrophobic silica having a primary average grain size of 16 nm) at 0.5% by weight and complex particles A at 0.6% by weight, followed by mixing using a Henschel mixer to yield a toner 1.

3 parts of the toner 1 and 100 parts of a resin-coated carrier (average grain size 100 μm) comprising a ferrite core material coated with a styrene/acrylic resin (styrene/methyl methacrylate=3:7) were mixed to yield a two-component developer 1 for the present invention.

Example 2

A two-component developer 2 for the present invention was obtained in the same manner as in Example 1 except that the complex particles A were replaced with 1.0% by weight of complex particles B.

Example 3

A two-component developer 3 for the present invention was obtained in the same manner as in Example 1 except that the complex particles A were replaced with 0.8% by weight of complex particles E.

Example 4

60 parts of styrene/acrylic copolymer binder resin (styrene/methyl methacrylate/butyl methacrylate=75/5/20), 30 parts of magnetite, 3 parts of polypropylene and 0.5 part of a salicylic acid derivative as a charge control agent were treated in the same manner as in Example 1 to yield magnetic colored particles 2 with an average grain size of 12.0 μm.

To the colored particles 2 were added fine powder of hydrophobic silica (primary average grain size 7 nm) at 0.4% by weight and complex particles C at 2.0% by weight, followed by mixing using a Henschel mixer to yield a toner, which alone was prepared to yield a one-component developer 3.

Example 5

A one-component developer 5 was obtained in the same manner as in Example 4 except that the complex particles C were replaced with 0.8% by weight of complex particles D.

Example 6

A one-component developer 6 was obtained in the same manner as in Example 4 except that the complex particles C were replaced with 0.65% by weight of complex particles F.

Comparative Example 1

A comparative two-component developer 5 was obtained in the same manner as in Example 1 except that the complex particles A were replaced with 0.6% by weight of comparative complex particles b.

Comparative Example 2

A comparative one-component developer 6 was obtained in the same manner as in Example 3 except that the complex particles C were replaced with 1.0% by weight of comparative complex particles a.

Comparative 3

A comparative one-component developer 7 was obtained in the same manner as in Example 3 except that the complex particles C were replaced with 1.0% by weight of comparative complex particles c.

Production of amorphous silicon photoreceptor

An amorphous silicon photoreceptor configured as shown in FIG. 1 was produced on a drum of aluminum base by glow discharge electrolytic method as follows.

After surface cleaning, a drum of aluminum base with smooth surface was placed in a vacuum chamber and kept heated within the range from 100° to 350° C. under an inside gas pressure of $10^{-8}$ Torr. Then, high purity argon gas was introduced as a carrier gas, followed by 10 minutes of preliminary discharge with a high frequency wave of 13.56 MHz frequency under a back pressure of 0.5 Torr.

Then, a reaction gas comprising $SiH_4$, $CH_4$ and $B_2H_6$ was introduced, and a gas mixture of Ar:$SiH_4$:$CH_4$:$B_2H_6$=1:1:1:1.5×$10^{-3}$ by flow rate was subjected to glow discharge deposition to sequentially form a charge blocking layer comprising a $P^+$ type amorphous silicon:C:H layer, a charge transport layer comprising an a-Si:C:H layer ([$B_2H_6$]/[$SiH_4$]=10 ppm by volume, [C]=10 atom %) and an interlayer comprising an a-Si:C:H layer ([$B_2H_6$]/[$SiH_4$]=9 ppm by volume, [C]=5 atom %) on the base at a deposition rate of 6 μm/hr. The thicknesses of the charge blocking layer, charge transport layer and interlayer were 0.5 μm, 10 μm and 1 μm, respectively.

Subsequently, supply of gases such as $CH_4$ was stopped and $SiH_4$ and $B_2H_6$ were subjected to discharge deposition to form a charge generation layer comprising an amorphous silicon:H layer ([$B_2H_6$]/[$SiH_4$]=0.1 ppm by volume) on the interlayer.

Then, an surface property improving gas comprising $O_2$, $CH_4$ and $N_2$ was discharge deposited while being introduced into the vacuum chamber at a flow rate of $O_2$:$CH_4$:$N_2$=20:60:20 to form a surface property improving layer with a thickness of 0.05 μm on the charge generation layer to yield an amorphous silicon photoreceptor A configured as shown in FIG. 1.

Image formation testing

Using each of the developers thus obtained, electrostatic images formed on amorphous silicon photoreceptors were developed to obtain toner images, which were transferred to image receiving materials, and the transferred toner images were fixed. The residual toner remaining on the amorphous silicon photoreceptor after transfer was cleaned off using a cleaning blade. This image formation process was followed by copy image formation tests.

For two-component developers, using the amorphous silicon photoreceptor A, a developing device for two-component developers and a modification of U-Bix 4060, an electrophotographic copying machine for two-component developers, produced by Konica Corporation, equipped with a cleaning apparatus with a cleaning blade, testing was conducted in which up to 100000 copies were taken under normal-temperature normal-humidity conditions at 20° C. temperature and 55% relative humidity (N.N conditions) and under high-temperature high-humidity conditions at 33° C. temperature and 80% relative humidity (H.H conditions).

For one-component developers, using the amorphous silicon photoreceptor A, a non-contact type developing device which applies an oscillating electric field to the developing region and a trial model of an electrophotographic copying machine for one-component developers equipped with a cleaning apparatus with a cleaning blade, testing was conducted in which up to 100000 copies were taken under normal-temperature normal-humidity conditions at 20° C. temperature and 55% relative humidity (N.N conditions) and under high-temperature high-humidity conditions at 33° C. temperature and 80% relative humidity (H.H conditions).

In the tests described above, the following items were assessed. The results are shown in Tables 4 and 5.

(1) Cleaning property 100000 copies were taken under normal-temperature normal-humidity conditions at 20° C. temperature and 55% relative humidity (N.N conditions), and the surface of the photoreceptor was macroscopically observed for adhering matter after cleaning using the cleaning blade every 10000 copies.

The evaluation criteria used are as follows:

A: Almost no adhering matter.

B: Small amount of adhering matter, but practically acceptable level.

C: A large amount of adhering matter posing a practical problem.

(2) Black streak stain and black dot stain attributable to adhering matter on the surface of photoreceptor 100000 copies were taken under normal-temperature normal-humidity conditions at 20° C. temperature and 55% relative humidity (N.N conditions), and the surface of the photoreceptor was macroscopically observed for adhering matter after cleaning using the cleaning blade every 10000 copies to determine the number of copies at which black streak stain or black dot stain occurred in the image portion corresponding to the part where the adhering matter existed.

(3) Black streak stain and black dot stain attributable to flaws on the surface of photoreceptor 100000 copies were taken under normal-temperature normal-humidity conditions at 20° C. temperature and 55% relative humidity (N.N conditions), and the surface of the photoreceptor was macroscopically observed for flaws every 10000 copies to determine the number of copies at which black streak stain or black dot stain occurred in the image portion corresponding to the portion where the flaw existed.

(4) Imaging failure

Actual copy taking tests were conducted under high-temperature high-humidity conditions at 33° C. temperature and 80% relative humidity (H.H conditions) at a pace of 10000 copies/day for 10 days, and the copies were macroscopically observed for imaging failure. Imaging failure is the phenomenon in which latent images leak due to surface deterioration of the photoreceptor and as a result the image portion corresponding to the deteriorated portion becomes unclear or liable to lose lateral lines.

(5) Image density

Actual copy taking tests were conducted under high-temperature high-humidity conditions at 33° C. temperature and 80% relative humidity (H.H conditions) at a pace of 10000 copies/day for 10 days, and the maximum image density $D_{max}$ was determined using the Sakura Densitometer (produced by Konica Corporation). The evaluation criteria used are as follows: At the determination of the density, the white background reflex density was taken as 0.0.

A: Density was not less than 1.25.

B: Density was not less than 1.1 and less than 1.25.

C: Density was less than 1.1.

(6) Fogging

Actual copy taking tests were conducted under high-temperature high-humidity conditions at 33° C. temperature and 80% relative humidity (H.H conditions) at a pace of 10000 copies/day for 10 days, and the relative density on a white background with an original density of 0.0 was determined using the Sakura Densitometer (produced by Konica Corporation). The white background reflex density was taken as 0.0. The evaluation criteria used are as follows:

A: Density was less than 0.01.

B: Density was not less than 0.01 and less than 0.03.

C: Density was not less than 0.03.

TABLE 4

| | Developer | Complex particles | 20° C. temperature, 55% relative humidity (N.N conditions) Cleaning property | Black streak stain and black dot stain attributable to adhering matter on the surface of photoreceptor | Black streak stain and black dot stain attributable to flaws on the surface of photoreceptor |
|---|---|---|---|---|---|
| Example 1 | 1 | A | Up to 100000 copies A | Up to 100000 copies A | Up to 100000 copies A |
| Example 2 | 2 | B | Up to 100000 copies A | Up to 100000 copies A | Up to 100000 copies A |
| Example 3 | 3 | E | Up to 100000 copies A | Up to 100000 copies A | Up to 100000 copies A |
| Example 4 | 4 | C | Up to 100000 copies A | Up to 100000 copies A | Up to 100000 copies A |
| Example 5 | 5 | D | Up to 100000 copies A | Up to 100000 copies A | Up to 100000 copies A |
| Example 6 | 6 | F | Up to 100000 copies A | Up to 100000 copies A | Up to 100000 copies A |
| Comparative Example 1 | 7 | b | At 60000 copies C | At 70000 copies C | At 50000 copies C |
| Comparative Example 2 | 8 | a | At 70000 copies C | At 80000 copies C | At 40000 copies C |
| Comparative Example 3 | 9 | c | At 60000 copies C | At 70000 copies C | At 60000 copies C |

TABLE 5

| | Developer | Complex particles | 33° C. temperature, 80% relative humidity (H.H conditions) Imaging failure | Image density | Fogging |
|---|---|---|---|---|---|
| Example 1 | 1 | A | Up to 100000 copies A | Up to 100000 copies A | Up to 100000 copies A |
| Example 2 | 2 | B | Up to 100000 copies A | Up to 100000 copies A | Up to 100000 copies A |
| Example 3 | 3 | E | Up to 100000 copies A | Up to 100000 copies A | Up to 100000 copies A |
| Example 4 | 4 | C | Up to 100000 copies A | Up to 100000 copies A | Up to 100000 copies A |
| Example 5 | 5 | D | Up to 100000 copies A | Up to 100000 copies A | Up to 100000 copies A |
| Example 6 | 6 | F | Up to 100000 copies A | Up to 100000 copies A | Up to 100000 copies A |
| Comparative Example 1 | 7 | b | At 30000 copies C | At 40000 copies C | At 30000 copies C |
| Comparative Example 2 | 8 | a | At 20000 copies C | At 30000 copies C | At 30000 copies C |
| Comparative Example 3 | 9 | c | At 70000 copies C | At 90000 copies C | At 90000 copies C |

What is claimed is:

1. An electrophotographic image forming method comprising steps of forming an static image on an amorphous silicon electrophotographic photoreceptor, developing said static image with a developer to form a toner image, transforming said toner image to an image receiving material, and cleaning toner remaining on the surface of said amorphous silicon photoreceptor, wherein said developer comprises a toner comprising colored particles comprising a resin and a colorant; and complex particles comprising resin particles comprising an acryl polymer, a styrene polymer or a styrene-acryl copolymer and hydrophobicized microparticles of an inorganic oxide which are bound to the surface of said resin particles.

2. The method of claim 1, wherein said complex particles have an average particle size of from 0.1 to 7.0 μm.

3. The method of claim 2, wherein said complex particles have an average particle size of from 0.2 to 5.0 μm.

4. The method of claim 1, wherein said microparticles have an average primary particle size of from 0.01 μm to 1 μm.

5. The method of claim 4, wherein said microparticles have an average primary particle size of from 0.01 μm to 0.5 μm.

6. The method of claim 1, wherein said microparticles has a hydrophobic degree of not less than 30.

7. The method of claim 1, wherein said microparticle comprises an inorganic oxide which is sparingly water-soluble and has a micro Vickers hardness of from 300 to 2500.

8. The method of claim 1, wherein said microparticles comprises silicon oxide, aluminum oxide, titanium oxide, zinc oxide, zirconium oxide, chromium oxide, cupper oxide, tin oxide, tellurium oxide, manganese oxide, boron oxide, barium titanate, aluminum titanate, magnesium titanate, calcium titanate or strontium titanate.

9. The method of claim 8, wherein said microparticles comprises titanium oxide, aluminum oxide, silico oxide or zirconium oxide.

10. The method of claim 1, wherein ratio of said microparticle to said resin in said complex particles is 5% to 100% by weight.

11. The method of claim 10, wherein ratio of said microparticle to said resin in said complex particles is 5% to 80% by weight.

12. The method of claim 1, wherein said toner contains said complex particles in an amount of from 0.01% to 5.0% by weight of said colored particles.

13. The method of claim 12, wherein said toner contains said complex particles in an amount of from 0.01% to 2.0% by weight of said colored particles.

14. An electrophotographic image forming method comprising steps of forming an static image on an amorphous silicon electrophotographic photoreceptor, developing said static image with a developer to form a toner image, transforming said toner image to an image receiving material, and cleaning toner remaining on the surface of said amorphous silicon photoreceptor, wherein said developer comprises a toner comprising colored particles comprising a resin and a colorant; and complex particles comprising resin particles comprising an acryl polymer, a styrene polymer or a styrene-acryl copolymer and hydrophobicized microparticles of an inorganic oxide selected from the group consisting of titanium oxide, aluminum oxide, silicon oxide and zirconium oxide which are bound to the surface of said resin particles.

* * * * *